United States Patent [19]

Colvin

[11] Patent Number: 4,689,887

[45] Date of Patent: Sep. 1, 1987

[54] ARCHERY SIGHT

[76] Inventor: Richard Colvin, 9 Alder La., Liverpool, N.Y. 13090

[21] Appl. No.: 877,649

[22] Filed: Jun. 23, 1986

[51] Int. Cl.[4] ..... F41G 1/32

[52] U.S. Cl. ..... 33/265; 33/241; 124/87

[58] Field of Search ..... 33/241, 265; 124/86, 124/87, 90

[56] References Cited

U.S. PATENT DOCUMENTS

| | | | |
|---|---|---|---|
| 3,450,122 | 6/1969 | Diamond | 33/265 |
| 3,866,592 | 2/1975 | Carella | 33/265 |
| 4,134,383 | 1/1979 | Flood | 124/87 |
| 4,170,071 | 10/1979 | Mann et al. | 33/241 |
| 4,179,613 | 12/1979 | Koren | 33/265 |
| 4,195,414 | 4/1980 | Robinson | 33/265 |
| 4,220,983 | 9/1980 | Schroeder | 33/241 |

*Primary Examiner*—Richard R. Stearns

*Attorney, Agent, or Firm*—D. Peter Hochberg

[57] ABSTRACT

A sighting device for use with an archery bow, comprising a mounting plate mountable on the bow; an elongated support track attached to the mounting plate; at least one blade-like sight element connected generally perpendicular to the support track, the blade-like element being oriented edge-wise relative to the line of sight of the archer, a light emitting diode attached to the blade-like element along the edge thereof facing the archer, the light emitting diode being electrically connectable to an electrical power source; switch means controlling activation of the light emitting diode by the electrical power source; means for manually adjusting the light emitting diode vertically and horizontally, and draw indicator means indicating the position of an arrow used with the bow, the draw indicator means being operative to switch the switch means to activate the light emitting diode when the arrow is at a predetermined position.

19 Claims, 7 Drawing Figures

ARCHERY SIGHT

FIELD OF THE INVENTION

The present invention relates to archery equipment, and more particularly to a bow-mounted sighting device to improve the aiming and shooting accuracy thereof.

BACKGROUND OF THE INVENTION

Accuracy in archery, whether hunting or target shooting, depends on the ability of the archer to control and compensate for several important variables which affect the flight of an arrow. For instance, to compensate for distance, the archer must adjust the elevation of the arrow i.e., increase the elevation, for longer distances and vice-versa. In like manner, horizontal angular adjustments must be made to compensate for windage. Especially important is that the archer repeatedly draw the arrow to the same anchor point or shooting position for each shot. This assures that the aforementioned adjustments, i.e., for wind and distance, result in the desired aim. Still further, it is important that the archer does not tilt or torque the bow up, down or laterally, as this will also effect the flight of the arrow. It can be seen therefore, that consistent accuracy requires a distance and windage adjustment, a consistent draw, and a motionless alignment of the bow. In this respect, it will also be appreciated that each variable effects the other. If one of these variables is not compensated for, the result necessarily is that the target will be missed or that successive arrow shots will be inconsistent.

With respect to aiming, some archers aim the bow by intuition, i.e., they elevate or lower the head of the arrow to compensate for the distance it is expected to fall during flight before hitting the target. Many archers on the otherhand employ bowsights. A bowsight may be provided with one or more sighting elements which are generally movable along a track extending parallel to the bowstring of the bow. These sighting elements are positioned on the track to correspond to distance or range. It will of course be appreciated that the position of the sighting elements is effected by the power of the bow and the draw of the individual archer. In other words, the position of these sighting elements as an indication of distance is a function of the above-identified variables.

Examples of bowsights known heretofore are shown in U.S. Pat. Nos. 4,495,705 to Kowalski et al; 4,220,983 to Schroeder; 4,177,572 to Hinds; 4,170,071 to Mann et al; and 4,136,462 to Topel. Many of these devices include light emitting diodes (LED's) or light bulbs to illuminate the aiming point. In general, these illuminated sights enable the archer to more easily align the aiming point with the target. While these sights do assist the archer in lining up the target, the desired aim is achieved only if the arrow is drawn to the proper draw position, and the bow is not tilted or torqued. In this respect, such devices offer no assistance to the archer. Moreover, on some of the above-identified devices, the LED's are mounted on threaded rods which restrict to some degree the archer's view of the target. It can therefore be appreciated that a sighting device will provide greater shooting accuracy only if aiming is coordinated with a consistent bow draw and a straight aligned bow.

In this respect, the present invention provides an illuminated sighting device having indicator means which enable the archer to ascertain when optimum conditions for shooting have been achieved. More specifically, the device provides an indication when the bow is torqued or tilted and indicates when a notched arrow is drawn to the proper draw position. The sighting device also improves the archer's view of the target, as well as providing an aiming point which is easily perceivable in the field of vision of the target.

SUMMARY OF THE INVENTION

In accordance with a preferred embodiment of the present invention, there is provided a sighting device for use with an archery bow. Broadly stated, the sighting device is comprised of light emitting aiming means connectable to an electrical power source, switch means controlling illumination of the light emitting aiming means, means for manually adjusting the position of the aiming means relative to the bow, and draw means operative to indicate when an arrow used with the bow is drawn to a predetermined position wherein the switch means is activated to illuminate the light emitting aiming means.

More specifically, a preferred embodiment of the invention is comprised of a mounting plate mountable on the bow. An elongated track or support bar is attached to the mounting plate in a position generally parallel to the bow string. The position of the track is adjustable relative to the mounting plate. Sight elements movable along the support track are connected thereto. The sight elements have a blade-like configuration and are mounted edgewise relative to the line of sight of the archer. A light emitting diode which is electrically connectable to an electrical power source is centrally affixed on the blade-like sight element along the edge thereof facing the archer. A switch is provided to control activation of the light emitting diode by the power source. A follower, in the form of a cord or line, is connected at one end to the switch and at the other end to the bow string wherein the switch is activated by the follower to illuminate the aiming point when the bowstring (and arrow) is drawn a predetermined distance.

Importantly, with the embodiment heretofore described, the archer is able to determine if the variables which effect shooting accuracy have been compensated for, and this can be accomplished without losing sight of the target. Because the blade-like elements are oriented edgewise relative to the archer, the field of view of the target is not obscured or hindered. In this respect, the blade-like sight elements seem to disappear from the archer's field of view when the archer focuses on the target. More importantly, when the arrow is drawn to the proper draw position, the light emitting diodes are illuminated to provide clearly visible aiming points against which the target can be sighted. Still further, the blade-like sight elements provide the archer with a way to check if the bow is tilted or torqued. In one respect, when viewing through the sighting device, if the blade-like element does not appear as a line to the archer (i.e., if the archer sees the upper surface or the lower surface of the blade), this indicates that the bow is tilted forward or backward. In another respect, because the light emitting diode is centrally located on the blade edge, the archer can use the blade as an indicator of vertical alignment of the bow. Parallel alignment of the blade-like sight element with the horizon will vertically align the bow, and thus prevent torquing or tilting thereof.

Thus, the present invention provides a sighting device which (1) enables the archer to adjust for distance by selecting a specific sight element, (2) indicates to the archer when the arrow is drawn to the proper shooting position, and (3) provides the archer with an indication as to whether the bow is vertically aligned. Importantly, all of these indicators are displayed for the archer on the sighting device, thereby enabling the archer to maintain concentration and view of the target.

In accordance with another aspect of the present invention, there is provided switch means controlling the connection of illuminated sighting device to an electrical energy source. This switch is operative sequentially from a first non-conductive condition to a second conductive condition to a third non-conductive condition. The switch is responsive to a follower attached to the bow string which shifts the switch from the first non-conductive condition to the second conductive condition to illuminate the sighting device when the bow string is drawn to a predetermined position relative to the bow. Movement of the bow string a select distance past the predetermined position, shifts the switch to the third non-conductive condition wherein the sighting device is no longer illuminated. In this respect, the select distance wherein the switch is in the second conductive condition, defines the proper draw position. The sequence of operation of the switch is such that, upon release of the bow string, the switch shifts in sequence from the third condition to the second condition to the first condition. In this respect there is provided a switching device which illuminates the sighting device only when a notched arrow is drawn to the proper draw position, thus providing the archer with an indication on the sight that the proper draw position has been achieved. If the arrow is overdrawn, i.e., is drawn past the select distance, the aiming points are no longer illuminated thus indicating an overdraw condition to the archer.

In accordance with another aspect of the present invention, a blade-like sight element having a light emitting aiming point thereon is provided. The sight element is of laminar construction, and is comprised of a generally matching pair of thin, elongated strips of electrically conductive metallic material having a layer of non-conductive material disposed therebetween. A light emitting component is affixed to one edge of the laminate structure with its positive terminal engaging the surface of one of the strips and its negative lead engaging the surface of the other strip. The metallic strips which form the blade-like sight element act as electrical leads to illuminate the light emitting component. In this respect, there are no wires, tubes or rods to obscure the line of sight of the archer.

An object of the present invention is to provide an accurate sighting device for an archery bow.

Another object of the present invention is to provide an archery sighting device which enables the archer to ascertain whether compensation is required with respect to the several variables which effect the flight of an arrow i.e., adjustment for distance, proper draw, and bow position or alignment.

Another object of the present invention is to provide a sighting device as described above wherein the archer can monitor the above-identified variables while viewing the target through the sighting device.

Another object of the present invention is to provide sighting device as described above which provides an unobstructed view of the target.

Another object of the present invention is to provide a sighting device which indicates to the archer when a notched arrow is drawn to the proper draw position.

Another object of the present invention is to provide a sighting device which provides an indication that the bow is torqued or tilted.

A further object of the present invention is to provide a sighting device which includes aiming points which can be illuminated.

A still further object of the present invention is to provide a sighting device as described above wherein the aiming points are illuminated only when a notched arrow is drawn to the proper draw position.

A still further object of the present invention is to provide a blade-like sight element which is oriented edgewise relative to the line of sight of the archer.

Another object to the present invention is to provide a blade-like sight element as described above having a light emitting aiming point mounted on the edge thereof, wherein the blade-like sighting element is a laminate structure comprised of two elongated, thin strips of electrically conductive metallic material having a thin layer of non-conductive material therebetween, such metallic strips being the electrical leads to the light emitting aiming point.

An even further object of the present invention is to provide a sequential switch device for controlling electrical current to a light emitting aiming point on an archery sight in response to a follower member attached to a bow string, wherein said switch device is operative to illuminate the light emitting aiming point only when a notched arrow is at a proper draw position.

These and other objects and advantages will become apparent from the following description of a preferred embodiment of the invention taken together with the accompanying drawings.

DRAWINGS

The invention may take physical form in certain parts and arrangement of parts, an embodiment of which is described in detail in the specification and illustrated in the accompanying drawings wherein.

DETAILED DESCRIPTION OF THE PREFERRED EMBODIMENT

Figure 1:
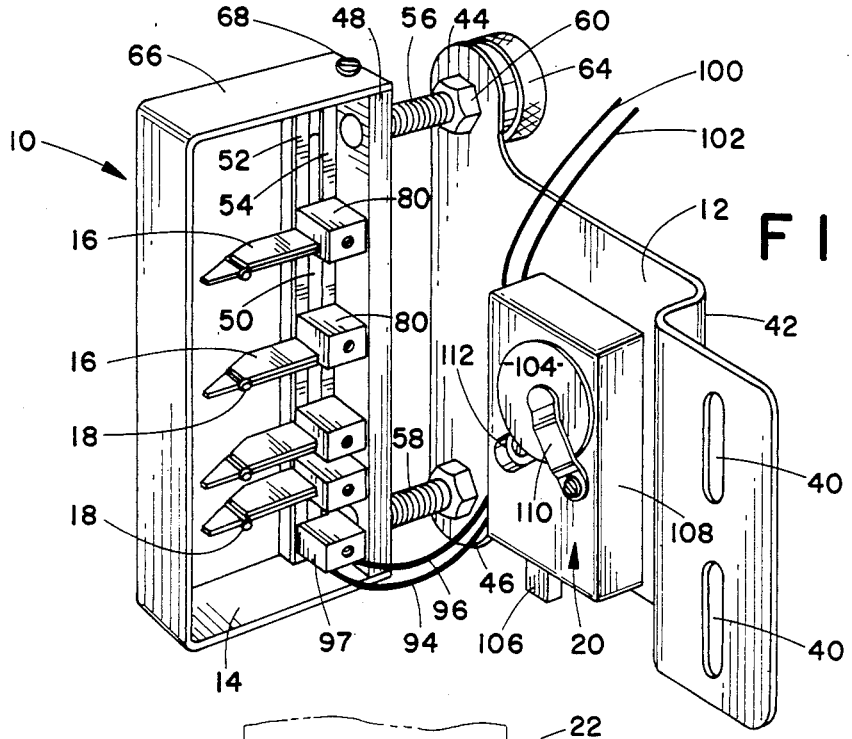
FIG. 1 is a perspective view of a sighting device for an archery bow illustrating a preferred embodiment of the present invention.

Referring now to the drawings wherein the showings are for the purpose of illustrating the preferred embodiment of the invention, and not for the purpose of limiting same, FIG. 1 shows an archery sight 10 constructed in accordance with the principles of the present invention. Sight 10 is generally comprised of a mounting plate 12 movably attached to a sight frame 14 having a plurality of blade-like sight elements 16. Each sight element 16 includes a light emitting aiming point 18, which point is electrically connectable to an electrical power source generally designated 20. Sight 10 is mountable to a conventional type archery bow 22 shown in phantom in FIG. 2. The bow in and of itself forms no part of the present invention. Bow 22, best seen in FIG. 3, includes a hand grip portion 24 with integral upper and lower limbs 26, 28 which terminate in tips 30, 32 respectively. A bow string 34 of conventional construction is strung between the upper and lower bow tips 30, 32. Above hand grip portion 24 a recess 36 defines an arrow rest 38 (best seen in FIG. 2).

Mounting plate 12 is generally rectangular and mounted to bow 22 by means of elongated mounting slots 40 provided at one end thereof. Slots 40 allow for vertical adjustment of sight 10 relative to bow 22. Slots 40 are dimensioned to correspond to sight mounting openings commonly provided on modern bows. Mounting plate 12 includes an offset portion 42 to generally align sight frame 14 relative to arrow rest area 38. Tab portion 44, 46 are provided at the other end of mounting plate 12, which tab portions 44, 46 have apertures therethrough normal to the plane of mounting plate 12.

Figure 2:
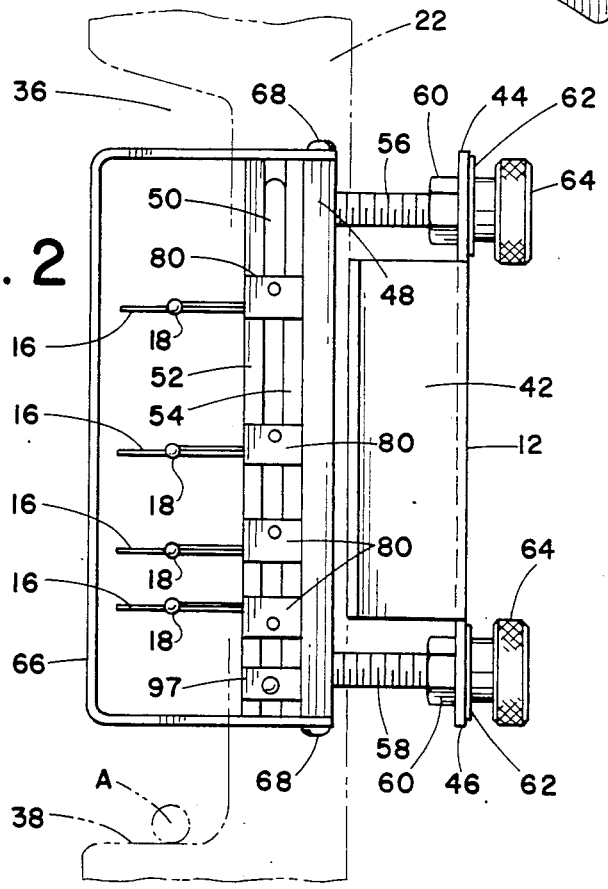
FIG. 2 is a front elevational view of the sighting device shown in FIG. 1.

Referring now to FIGS. 1 and 2, sight frame 14 includes an elongated support bar or track 48. Support track 48 has a generally L-shaped cross-sectional configuration best seen in FIG. 4. An elongated, centrally located slot 50 extends longitudinally through one leg of L-shaped support track 48. A pair of electrically conductive strips or rails 52, 54 are provided on opposite sides of slot 50 and extend along the length of support track 48. Support track 48 is preferably formed of a lightweight, nonconductive plastic material, but may be formed of a metallic wherein conductive rails 52, 54 are electrically insulated therefrom. Extending laterally to one side of support track 48 from the ends thereof are threaded rods 56, 58. Threaded rods 56, 58 extend through the associated apertures in tab portions 44, 46 of mounting plate 12. A backing nut 60, a washer 62, and knurled thumb nut 64 are threaded onto each rod 56, 58 such that the respective tab portions 44, 46 are interposed between backing nut 60 on one side and washer 62 and knurled nut 64 on the other. The position of backing nut 60, washer 62 and knurled nut 64 on rods 56, 58 determine the spacing of sight 14 relative to mounting plate 12. As will be appreciated, the spacing between support track 48 and mounting plate 12 can be changed by turning the nut assemblies farther onto rods 56, 58 toward frame 14. Thus there is provided means for horizontally adjusting the relative position of sight frame 14 with respect to bow 22. As seen in the drawings, sight frame 14 is oriented generally parallel to the plane of mounting plate 12. In this respect, support track 48 is mounted generally parallel to bow string 34. A U-shaped guard 66 secured to support track 48 by screws 68 is provided to protect sight elements 16.

Figures 4, 5, 6A, 6B:
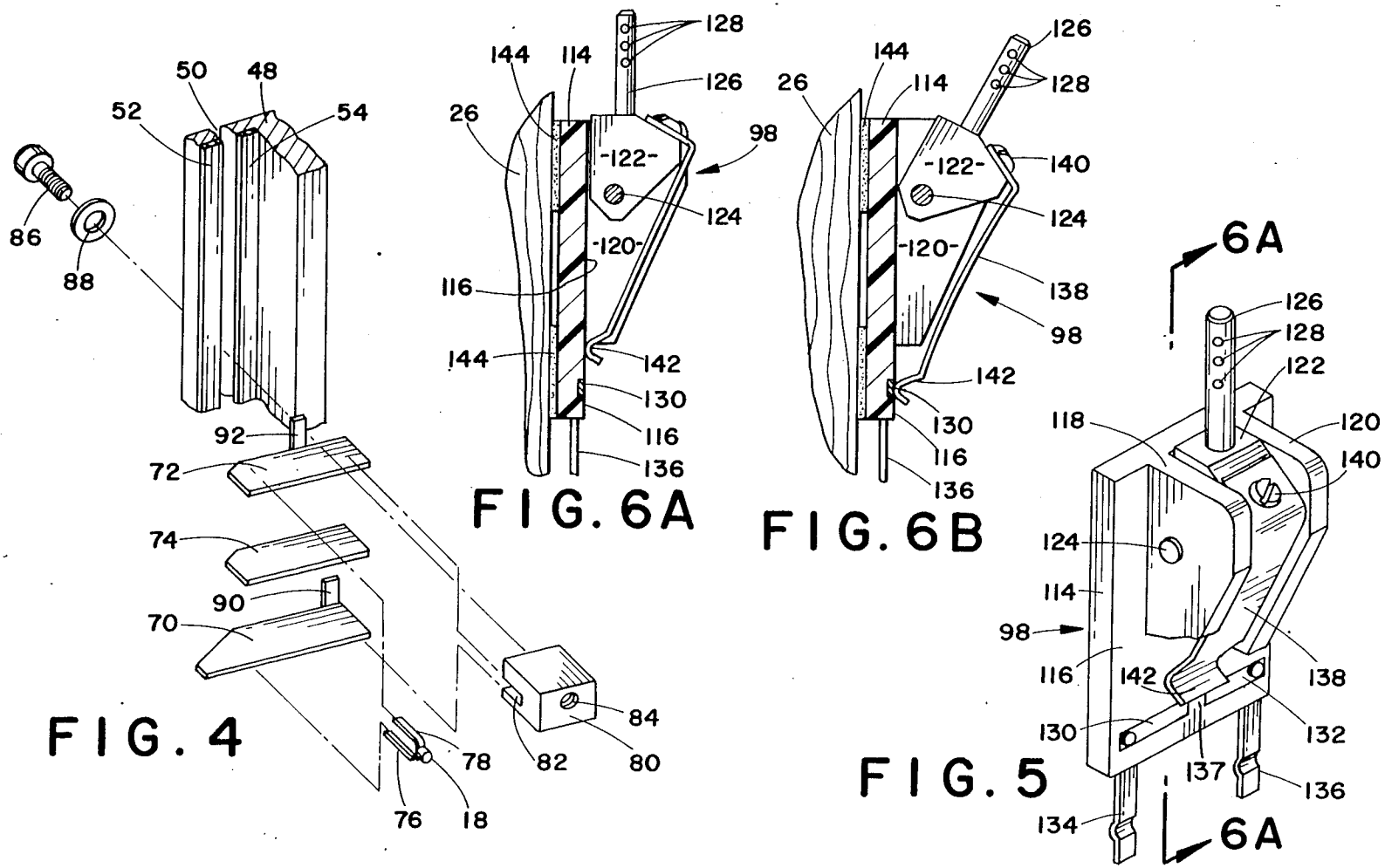
FIG. 4 is an exploded perspective view of a sighting element illustrating a preferred embodiment of one aspect of the present invention.
FIG. 5 is a partially sectioned, perspective view of a switch element for use with the sighting device shown in FIG. 1 illustrating a preferred embodiment of another aspect of the present invention.
FIGS. 6A and 6B are sectional views of the switch shown in FIG. 5 illustrating the operation thereof.

Blade-like sight elements 16 are mounted generally perpendicular to support track 48, such that sight elements 16 are horizontal with respect to bow string 34. The construction and mounting of sight elements 16 is shown in FIG. 4. Blade-like sight elements 16 are each comprised of a pair of thin, electrically conductive, metallic blades 70, 72 having a non-conductive layer 74 therebetween. Blades 70, 72 and non-conductive layer 74 together form an integral laminar blade-like structure as shown in FIGS. 1 and 2. In the embodiment disclosed, light emitting aiming point 18 is a light emitting diode (LED) mounted to the edge of the blade-like structure. The LED includes leads 76, 78 and is generally centrally mounted to the blade-like structure along the edge which faces the archer. The LED is mounted such that lead 76 is in electrically conductive contact with blade 70 and lead 78 is in electrically conductive contact with blade 72. A mounting block 80 of non-conductive material is provided with a slot 82 to receive the blade-like structure therein in press-fit fashion. Mounting block 80 also includes a threaded aperture 84 extending therethrough, which aperture 84 is offset from slot 82. Aperture 84 receives the threaded end of a fastener 86 which extends through slot 50 in track 48 and which together with a washer 88 releasably fastens blade-like sight element 16 to support track 48. As seen in FIG. 4, blade 70 and 72 include laterally extending tabs 90, 92 respectively. Tabs 90, 92 are operative to engage in electrically conductive fashion rail 52, 54 respectively when mounting block 80 is fastened to support track 84.

In the embodiment heretofore described, blades 70, 72 are formed from brass and phosphor bronze spring material having a thickness of approximately 0.012". Non-conductive layer 74 is an insulating epoxy which bonds blades 70, 72 together. In this respect, it will be appreciated that the drawings exaggerate the thickness of the blade-like sight elements 16. The actual thickness of element 16 is approximately 0.030 inches. It will further be appreciated that these dimensions are presented for the purposes of illustration only and are not meant to limit the invention in any way.

Rails 52, 54 of support track 48 are electrically connected by lead wires 94, 96 to a power source designated 20. The ends of wires 94, 96 are exposed and maintained in contact with rails 52, 54 respectively by a mounting block 97 as shown in FIGS. 1 and 2. Mounting block 97 is generally similar to mounting blocks 80 with the exception that it has no blade-like sight elements associated therewith. Power source 20 provides the current to rails 52, 54 and in turn to blades 70, 72 to illuminate aiming point 18. A switch 98 is electrically connected to power source 20 by wires 100, 102.

With respect to power source 20, a long-life cell 104 is provided together with means to regulate power therefrom. Cell 104 is regulated by a simple resistance circuit (not shown) including two resistors and a switch 106 (partially shown). In this respect, the switch controls the current through the light emitting diodes of aiming points 18 and the intensity thereof. In the illustrated embodiment, a generally rectangular block of non-conductive plastic material is provided to contain cell 104, the resistance circuit and switch 106. To this end, a cavity (not shown) is provided in the lower portion of block 108 to receive switch 106 and the resistor arrangement. A thermosetting resin is then used to seal and encase the components within block 108. In this respect, all wire connections are also preferably enclosed within the resin to environmentally seal and protect same. Cell 104 is maintained within block 108 by a removable pole contact 110, which is internally connected to the wiring circuit encased within block 108. A second pole contact 112 engages the other pole of cell 104 and is also internally connected to the wiring circuit. Thus, there is provided a simple power source having a battery which can be replaced and an environmentally sealed wiring circuit.

In accordance with one aspect of the present invention, an embodiment of switch 98 is shown in FIG. 5. Switch 98 is generally comprised of a base portion 114 having a planar upper surface 116. A pair of parallel, spaced wall sections 118, 120 extend perpendicularly from surface 116. Disposed between wall section 118, 120 is a switch body member 122 pivotally movable about a pin 124 which extends through wall sections 118, 120. The axis of pin 124 is generally parallel to surface 116. Body member 122 includes an elongated rod or arm 126 extending therefrom having a plurality of apertures 128 therethrough. The parts of the switch heretofore described are preferably comprised of a non-conductive material, and in the embodiment disclosed, are of molded plastic construction. A pair of axially spaced elongated switch contacts 130, 132 are provided flush to surface 116. Contacts 130, 132 are conductively connected to terminal bars 134, 136 respectively, which bars 134, 136 are for connection to. wires 100, 102 from power source 20. As best seen in FIG. 5, a gap 138 exists between contacts 130, 132. An elongated electrically conductive switch blade 138 is attached to body member 122 by fastener 140. Blade 138 is generally an elongated strip of electrically conductive spring material having a contoured or hook shaped portion 142. The configuration of switch 98 and the resiliency of blade 138 are operative to maintain portion 142 in contact with surface 116 and at the same time to bias switch 98 to a normally open condition shown in FIG. 5.

Referring now to the operation of switch 98, FIGS. 6A and 6B show sectional views of switch 98 taken along a plane disposed between wall section 118 and switch body member 122. FIG. 6A shows switch 98 in its normal open configuration. If rod 126 is moved to the right with respect to body member 122, switch 98 assumes the configuration shown in FIG. 6B. In this respect, rotation of body member 122 is translated into linear motion of hook portion 142 along surface 116. In the position shown in FIG. 6B, hook portion 142 of blade 138 is positioned over and electrically connects contacts 130 and 132. Further rotation of body member 122 urges hook portion 142 past contacts 130, 132 thereby opening switch 98. Switch 98 thus provides a limited activation position responsive to the angular position of body member 122.

As illustrated in FIG. 6B, the resiliency of blade 138 causes it to assume a bowed configuration as body member 122 is rotated. In this respect, blade 138 acts as a spring to bias body member 122 to the position shown in FIG. 6A when the force acting on rod 126 is removed. Thus, there is provided a biased, three condition switch, operative in sequence in both directions.

Figure 3:
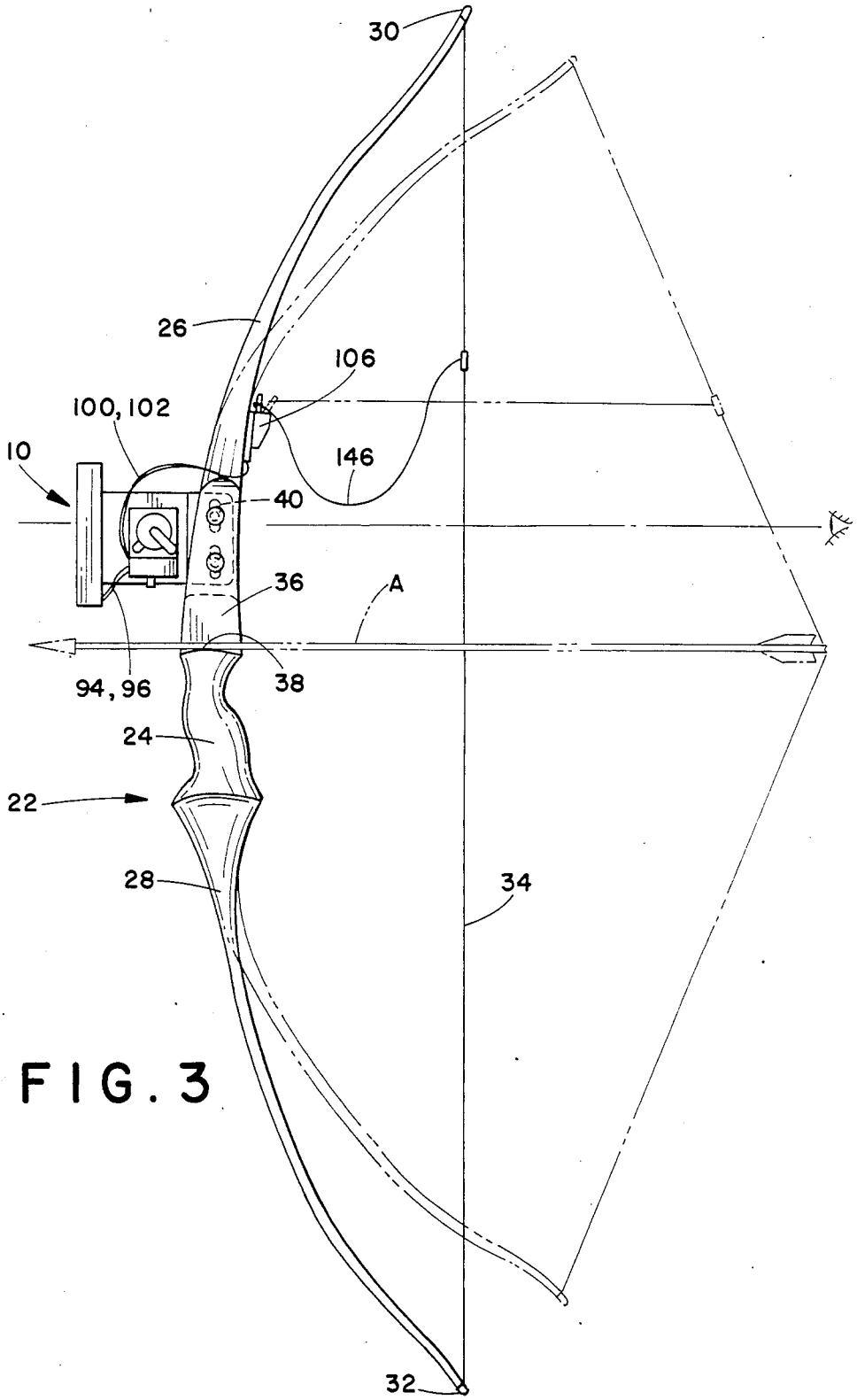
FIG. 3 is a side elevational view of an archery bow having a sighting device as shown in FIG. 1 mounted thereon.

Switch 98 is preferably mounted on upper bow limb 26 as seen in FIG. 3. Switch 98 can be mounted by double sided foam tape 144 or by other conventional means. The exact position of switch 98 relative to limb 26 is not critical. A follower 146 in the form of a cord or line is secured at one end to bow string 134 and at the other end to switch arm 126 by utilizing apertures 128. The length of follower 146 is dimensioned to operatively close switch 98 when bow string 34 is drawn a predetermined distance as illustrated in phantom in FIG. 3. In this respect, allowance is to be made for the bending of bow limbs 26, 28 as illustrated in FIG. 3.

Referring now to the operation and use of the above-identified embodiment, sight 10 is mounted to bow 22 as seen in FIG. 3. Mounting plate 12 is attached directly to bow 22 with two screws (not shown) as is conventionally known. Power source 20 is mounted to mounting plate 12 preferably by double sided foam tape. Wires 94, 96 from power source 20 are attached to rails 52, 54 by mounting block 97 as discussed above. Switch 98 is mounted to bow limb 26 as shown in FIG. 3 and wires 100, 102 from power source 20 are connected to switch terminal bars 134, 136. Follower 146 is then attached to switch arm 126 and bow string 34. The sighting arrangement is now ready for adjustment.

Vertical adjustment of sight 14 is accomplished by movement of mounting plate 12 relative to bow 22, which movement is facilitated by elongated mounting slots 40. Horizontal adjustment of sight frame 14 is accomplished by repositioning backing nuts 60 and knurled nuts 65 on threaded rods 56, 58. In this respect, aiming points 18 are preferably aligned with the position of an arrow designated A as shown in FIG. 2. Blade-like sight elements 16 are movable along support track 48 by loosening fastener 86. Sight elements 16 are positioned by the individual archer to be indicative of different distances.

Because of the physical differences from one archer to another, as well as physical differences in archery bows, the length of follower 146 must be independently adjusted. Follower 146 should be adjusted such that aiming points 18 will be illuminated only at a full draw position as shown in phantom in FIG. 3. In other words, proper follower adjustment will effect illumination of aiming points 18 only when a notched arrow is fully drawn. As will be appreciated from the description of switch 98, overdraw of the bow string will cause the aiming point to be switched off. Thus there is provided a proper draw "window" or "range" to indicate to the archer the optimum draw position.

In operation, sight 10 provides the archer with indicators to ascertain whether the variables which effect shooting accuracy require correction. As set forth above, blade-like configuration of sight elements 16 provides the archer with a horizontal reference to indicate whether the bow is torqued or tilted, the plurality of sight elements 16 provides adjustment means to compensate for distance to the target, and the follower and switch arrangement are operative to indicate to the archer when arrow A is at the proper draw position. Thus, there is provided a sighting device wherein indicators with respect to the variables which effect shooting accuracy are presented for the archer within his field of vision of the target.

Importantly, the present invention provides an almost totally unobstructed view of the target. In this respect, as best seen in FIG. 2, because blade-like sight elements 16 are viewed edgewise and are extremely thin (as set forth above, the drawings exaggerate the thickness of such elements which are approximately 0.030 inches in thickness in the disclosed embodiment), such elements seem to disappear from the archer's field of view when the archer focuses on the target. Likewise, there are no wires or posts to obstruct the archer's vision. Moreover, aiming points 18 appear suspended in space, and when illuminated are easily aligned with the target.

With regard to light emitting aiming point 18, the power regulating arrangement (resistor circuit) discussed above, allows the archer to compensate for ambient lighting conditions, i.e., low aiming point intensity in dark, poorly lit surroundings or high intensity in bright surroundings. This compensation feature prevents an over bright aiming point from dominating the field of vision in dark surroundings. Still further, inasmuch as aiming points 18 are illuminated only when the proper draw position is reached, the disclosed sighting device uses less power than other illuminated sights because the sight is not constantly illuminated. Also important is that all aiming points are illuminated when the proper draw is reached wherein the archer can easily select the appropriate sight element in accordance with the distance to the target.

The present invention thus provides the sighting device which is easy to use and which enables the archer to more accurately locate and sight the target. Although the invention has been described with respect to a preferred embodiment, modifications will occur to others upon their reading and understanding of this specification. For example, switch 98 could include a second pair of contacts connected to a resistor circuit wherein the switch could provide an illuminated aiming point having a "stepped-illumination" window. It is intended that all such modifications and alterations be included insofar as they come within the scope of the patent as claimed or the equivalence thereof.

I claim:

1. A sighting device for use with an archery bow, comprising:

a mounting plate mountable on said bow;

an elongated support track attached to said mounting plate;

at least one blade-like sight element connected generally perpendicular to said support track, said blade-like element oriented edge-wise relative to the line of sight of the archer, a light emitting diode attached to said blade-like element along the edge thereof facing the archer, said light emitting diode electrically connectable to an electrical power source;

switch means controlling activation of said light emitting diode by said electrical power source;

means for manually adjusting said light emitting diode vertically and horizontally, and draw indicator means indicating the position of an arrow used with the bow, said draw indicator means operative to switch said switch means to activate said light emitting diode when said arrow is at a predetermined position.

2. A sighting device as defined in claim 1 wherein said switch means deactivates said light emitting diode if said arrow is moved a preselected distance past said predetermined position.

3. A sighting device as defined in claim 1 wherein said light emitting diode is approximately centrally located along the edge of said blade-like sight element.

4. A sighting device as defined in claim 1 wherein said indicator means is a follower connected at one end to the bow string on said bow and at the other end to said switch means.

5. A sighting device as defined in claim 1 wherein said adjusting means comprises:

horizontal adjustment means for varying the distance between said mounting plate and said support track, and vertical adjustment means for repositioning said blade-like sight element on said support track.

6. A sighting device as defined in claim 1 further comprising means for altering the light intensity of said light emitting diode.

7. A sighting device for use with an archery bow comprising:

mounting means for mounting said sighting device to said bow;

one or more blade-like sight elements oriented edge-wise relative to the line of sight of an archer using the bow;

light-emitting aiming means attached to said blade-like sight elements electrically connectable to an electrical power source;

said light-emitting aiming means being attached to the edge of said sight element facing an archer using the bow;

switch means controlling illumination of said light-emitting aiming means;

means for manually adjusting the position of said aiming means;

draw means operative when the bow is drawn to a predetermined position to effect activation of said switch means to illuminate said light-emitting aiming means.

8. A sighting device as defined in claim 7 wherein, said switch means is a switch having a first normal aiming means off condition, a second aiming means on condition and a third aiming means off condition, and said draw means includes a follower member secured at one end to said switch means and at the other end to the bow string on said bow, said follower member operative to effect said second aiming means on condition when said bow string is drawn to said predetermined position and to effect said third aiming means off condition when said bow string is drawn past said predetermined position.

9. A sighting device as defined in claim 7 further comprising means for altering the light intensity of said light emitting aiming means.

10. An illuminated bowsight for use with an archery bow, said bowsight comprising:

light emitting aiming means;

means for electrically connecting said aiming means to an electrical energy source;

means for mounting said aiming means on said bow relative to the line of sight of the archery; and, a switch comprised of:

a base portion of nonconductive material having a generally planar surface, electrical contact means mounted in said base portion flush with said planar surface, and a switch member movable on said surface to electrically engage said contact means, said switch being operative to control the connection of said aiming means to said electrical power source in response to movement of the bow string on the bow, said switch having a first normal aiming means off condition and a second aiming means on condition, said switch being in said second aiming means on condition when said bow string is drawn to a predetermined position, and a third aiming means off condition, said switch assuming said third condition when said bow string is drawn past said predetermined position.

11. A bowsight as defined in claim 10 wherein said switch further comprises:

a switch arm associated with said switch member pivotally mounted to said base portion, said switch arm operative to move said switch member from said first normal aiming means off condition to said second aiming means on condition when said bow string is drawn to said predetermined position.

12. A bowsight as defined in claim 11 wherein said switch includes a follower connecting said switch arm to said bow string.

13. A bowsight as defined in claim 10 wherein said switch includes means biasing said switch towards said first condition.

14. A bowsight as defined in claim 10 wherein said switch member is spring steel operative to bias said switch to said first condition.

15. A sight for use with an archery bow or the like comprising:

a blade-like element;

means for mounting said blade-like element to said bow wherein said element is oriented edgewise relative to the line of sight of the archer;

a light emitting aiming point secured on the edge of said element;

conductive means in contact with said light emitting aiming point; and, means for electrically connecting said conductive means to an electrical power source.

16. A sight as defined in claim 15, where said blade-like element is comprised of two elongated, thin strips of an electrically conductive material and an intermediate, thin layer of a non-conductive material insulating said conductive strips from each other, said strips and intermediate layer bonded together to form a laminar structure.

17. A sight as defined in claim 16 wherein said light emitting aiming point is a light emitting diode wherein the positive terminal of said diode is connected to one of said strips and the negative terminal of said diode is connected to the other of said strips.

18. A sight as defined in claim 15 wherein said light emitting aiming point is a light emitting diode and is oriented on the edge of said blade-like element facing an archer using the bow.

19. A sight as defined in claim 15 further comprising a support bar;

means for mounting said support bar to said bow in a position generally parallel to said bow string; and, electrical terminal means on said support bar connected to said electrical power source, said blade-like element extending perpendicularly from said support bar with said light emitting aiming point electrically connected to said terminal means.

* * * * *